US010465722B2

(12) United States Patent
Stoesser et al.

(10) Patent No.: US 10,465,722 B2
(45) Date of Patent: Nov. 5, 2019

(54) MULTIPLE VALVE CORE, MULTIPLE VALVE AND VALVE ARRANGEMENT

(71) Applicant: BUERKERT WERKE GMBH & CO. KG, Ingelfingen (DE)

(72) Inventors: Harry Stoesser, Mueglitztal (DE); Michael Frech, Weinsberg (DE); Heiko Engler, Forchtenberg (DE)

(73) Assignee: BUERGERT WERKE GMBH & CO. KG, Ingelfingen (DE)

( * ) Notice: Subject to any disclaimer, the term of this patent is extended or adjusted under 35 U.S.C. 154(b) by 168 days.

(21) Appl. No.: 15/788,856

(22) Filed: Oct. 20, 2017

(65) Prior Publication Data

US 2018/0112687 A1 Apr. 26, 2018

(30) Foreign Application Priority Data

Oct. 20, 2016 (DE) ..... 10 2016 120 025

(51) Int. Cl.
*F15B 13/08* (2006.01)

(52) U.S. Cl.
CPC ..... *F15B 13/0814* (2013.01); *F15B 13/0871* (2013.01); *F15B 13/0839* (2013.01)

(58) Field of Classification Search
None
See application file for complete search history.

(56) References Cited

U.S. PATENT DOCUMENTS 7,909,064 B2 * 3/2011 Natili, Jr. ..... F15B 13/0817 137/884

FOREIGN PATENT DOCUMENTS

| | | | |
|---|---|---|---|
| EP | 2746593 | A1 | 6/2014 |
| WO | 2008/125131 | A1 | 10/2008 |
| WO | 2011112515 | A2 | 9/2011 |

* cited by examiner

*Primary Examiner* — John Fox
(74) *Attorney, Agent, or Firm* — McNees Wallace & Nurick LLC

(57) ABSTRACT

A valve assembly comprises at least one multiple valve having a duct module which includes at least one elongated fluid duct which extends in a straight line along a longitudinal direction and a plurality of branch ducts which open in openings in the fluid duct which are arranged side by side along the longitudinal direction in the inner wall of the fluid duct. The multiple valve comprises at least one multiple valve core which is inserted into the fluid duct such that each valve seal can seal one of the openings. The multiple valve core comprises an elongated carrier and at least one valve element, the carrier having at least one support portion for abutment against the inner wall of the fluid duct and at least one receiving area in which the valve element is connected to the carrier so as to be non-displaceable in the longitudinal direction of the carrier. A plurality of valve seals for closing the openings which are provided on one or on a plurality of valve elements is provided, the valve seals being arranged successively in the longitudinal direction of the carrier and being movable in a closing direction perpendicular to the longitudinal direction. The duct module forms part of a basic module on which a plurality of valve modules fluidically connected to the branch ducts can be mounted, the valve modules being in particular configured so as to be adapted to actuate pressure pieces in the branch ducts which cooperate with the valve seals of the valves of the multiple valve to permanently open the respective valve.

18 Claims, 8 Drawing Sheets

MULTIPLE VALVE CORE, MULTIPLE VALVE AND VALVE ARRANGEMENT

The invention relates to a multiple valve core, a multiple valve and a valve arrangement having a multiple valve which comprises a multiple valve core.

BACKGROUND OF THE INVENTION

Valve arrangements, for example in the form of a valve island, often include a basic module on which different valve modules are received. It is desirable that individual valve modules can also be exchanged during operation. To prevent fluid from unintentionally flowing out of the free plug-in locations of the basic module, a check valve can be inserted into the respective fluid connection in the basic module of the valve island which prevents an outflow of fluid if no valve module is plugged thereon. The check valve is configured such that it can be moved into a permanently open position under the influence of the valve module in order to permit a fluid flow to the valve module. This principle is for example shown in document WO 2008/125131 A1.

The fitting of the individual check valves for the respective fluid connections is time-consuming and thus cost-intensive.

The object of the invention is to simplify the fitting of check valves in a valve arrangement such as a valve island and thus to design the valve arrangement in a more cost-effective manner.

BRIEF DESCRIPTION OF THE INVENTION

This object is achieved, on the one hand, with a multiple valve core having the features of claim 1. The multiple valve core is intended to be inserted into an elongated fluid duct which extends in a straight line along a longitudinal direction and which includes an inner wall having a plurality of openings arranged side by side along the longitudinal direction. The multiple valve core includes an elongated carrier and at least one valve element, the carrier comprising at least one support portion for abutment against the wall of the fluid duct and at least one receiving area in which the valve element is connected with the carrier so as to be non-displaceable with respect to the carrier in the longitudinal direction thereof. A plurality of valve seals for closing the openings which are provided on one or on a plurality of valve elements is provided, the valve seals being arranged successively in the longitudinal direction of the carrier and being movable in a direction perpendicularly to the longitudinal direction. According to the invention, a plurality of fluid connections can simultaneously be equipped with check valves by one single multiple valve core such that the mounting effort is considerably reduced in comparison with the prior art. The multiple valve core is preassembled to the extent that it can simply be inserted into a fluid duct of the valve assembly and need merely be positioned in the desired place below the openings to be closed. Since the valve element is firmly fastened to the carrier, the valve seals are automatically brought in their desired positions by an appropriate positioning of the carrier.

The carrier is normally rigid and is preferably configured in one piece, for example of an appropriate plastic material.

To not hinder the fluid flow through the fluid duct, the cross-section of the carrier should permit a sufficient fluid flow in the longitudinal direction. This can be achieved by interruptions and recesses and an appropriate shape of the cross-section of the carrier, for example. The cross-section of the fluid pipe is nowhere completely closed by the carrier and preferably not by another component of the multiple valve core, either.

The valve seals are in particular configured and can be arranged in the fluid duct below the openings such that a fluid flow through the opening can be entirely stopped.

The valve elements are preferably configured such that a fluid flow through the fluid duct in the direction of the openings in the wall of the fluid duct deflects the valve seals perpendicularly to the longitudinal direction, presses them against the wall and thus closes the opening. The valve seals act as check valve and prevent a fluid from exiting the fluid duct through the opening.

Two support portions which are arranged substantially parallel to each other may for example be provided, the receiving area being located between the support portions and extending perpendicularly thereto. The cross-section of the carrier may then be approximately U-shaped. Such a configuration is particularly suitable for fluid ducts having a rectangular or a generally polygonal shape in which the carrier can thus abut against two parallel walls of the fluid duct.

The support portions and the receiving area can also be configured in a curved manner for the use in fluid ducts having a round or oval cross-section to obtain a better rest of the carrier and of the valve seals against the inner wall of the fluid duct.

It is also possible to provide a single support portion which is then preferably arranged centrally below the receiving area such that the receiving area and the support portion, as seen in cross-section, are approximately T-shaped. A sufficient support effect of the carrier is also obtained in this case to reliably hold the valve seals in their desired position below the openings and permit a secure closing of the openings by the valve seals.

In a preferred embodiment, at least one valve element is provided on which several valve seals are arranged. Two to ten valve seals, in particular three to six valve seals can for example be formed on one valve element. The valve element preferably has a total of four valve seals.

It is possible to provide a single valve element on the carrier on which all valve seals are arranged. It is similarly of course conceivable to arrange a plurality of valve elements each having a plurality of valve seals on a single carrier.

The individual valve seals in the valve element can for example be manufactured in that at least one of the valve seals is limited by a particularly linear recess in the valve element. To this end, the valve seal can for example be partly cut out or punched along its periphery. In this case, a simple manufacture of the sealing elements from a plastic foil is possible. The contour can also remain recessed during injection-molding by a narrow web in the tool.

It is advantageous if the valve element is plate-shaped and rests on the receiving area between the valve seals as seen in the longitudinal direction. The valve seals can thus be sufficiently supported on the carrier, and the valve element can as whole be flexible.

The valve element preferably cooperates with an interlocking fit structure which is formed in the receiving area on the carrier and prevents the valve element from being displaced in the longitudinal direction with respect to the carrier. The interlocking fit structure for example comprises at least one projection in the receiving area which is arranged so as to block a displacement of the valve element in the longitudinal direction. The projection(s) can project from the long sides of the carrier into the receiving area, could however also be arranged onto the support surfaces between the valve seals, for example. Advantageously, the projections have perpendicularly to the surface of the valve element an extension corresponding at least to the thickness of the valve element such that the valve element can reliably be held on the projections, in particular while the multiple valve core is inserted into the fluid duct.

The valve element is preferably made of a rubber elastic plastic material, for example a rubber or any other elastomer. The valve element is preferably simply placed onto the carrier. It is however also conceivable to provide a fix fastening between the carrier and the valve element, for example via a latching connection, or in that the valve element is injection-molded to the carrier. It is possible to use a single material for the entire valve element including the valve seals. The valve seals could also be integrally formed with the remaining valve element.

For a protection of the valve element upon insertion into the fluid duct, the carrier can extend at least on its long sides perpendicularly to the receiving area and thus also perpendicularly to the valve element at least up to an upper side of the valve element. The lateral edges of the valve element are in this way protected by the carrier.

The receiving area is preferably configured such that transversely to the longitudinal direction, one wall portion of the receiving area adjoins on either side a lateral edge of the valve element such that a contact of the lateral edges of the valve element with the wall of the fluid duct is prevented and the valve element which in most cases is made of a softer material than the carrier is protected by the carrier. The valve element can be located in a recess of the carrier such that a contact with the inner wall of the fluid duct is prevented especially upon insertion of the multiple valve core into the fluid duct.

As seen transversely to the longitudinal direction, the receiving area is preferably arranged substantially in the center of the carrier in order to permit a simple positioning with respect to the openings which are normally also arranged in the center with respect to the fluid duct.

The entire sealing element preferably defines a surface, wherein in the non-deflected state, the valve seals are located in the surface and do not project from the remaining sealing element. In the finished multiple valve core and when the sealing element is mounted on the carrier on the receiving area, the surface can be flat or curved depending on the shape of the receiving area.

It is of course also possible to injection-mold the valve elements directly to the carrier. In this case, it can also be advantageous to configure the valve elements such that each of these valve elements bears only one valve seal, and to provide the valve elements on the carrier with a distance according to the distances of the openings in the fluid duct so as to save material.

A movement of the valve seals perpendicularly to the longitudinal direction towards the interior of the fluid duct can be limited to a desired maximum amount by forming stops in the receiving area against which the valve seal abuts after a certain deflection. The stops are preferably integrally formed with the carrier.

In a further preferred embodiment, the receiving area has a plurality of apertures in the carrier which are separate from each other and into which a respective valve element having a single valve seal is inserted. The edge of the apertures can be structured correspondingly in order to permit a fix fastening of the valve element in the carrier.

In this case, in addition to the valve seal, the valve element can have a tappet which is connected to the valve seal and is guided in the carrier, and a spring element which is arranged between the receiving area and the valve seal. The spring element urges the tapped and thus the valve seal preferably towards the wall of the fluid duct, i.e. towards the opening.

The valve seal can be fastened directly to the tappet by injection-molding or by means of a latching connection, for example.

The tappet preferably extends through the aperture and can be guided along the wall of the aperture.

In this case, a single support portion is preferably provided on the carrier which is configured as a central web on the carrier on the side opposite the valve element, and includes recesses in the region of the apertures.

The spring element is preferably a compression spring which generates a preload perpendicularly to the longitudinal direction away from the receiving area.

All parts of the valve element can be captively connected with each other, for example by latching such that all components of the multiple valve core remain securely fastened to each other upon insertion of the multiple valve core into the fluid duct.

The tappet can be made of the same material as the carrier, for example of an appropriate plastic material. The valve seal is preferably made of a softer plastic material such as rubber or another elastomer.

In this embodiment, the carrier and the valve elements are preferably manufactured as separate components, for example each in a plastic injection-molding process, and are assembled during the mounting of the multiple valve core.

In all embodiments, the receiving area may generally be oriented such that a plurality of apertures is provided successively in the longitudinal direction. It is in particular possible to provide rigid portions on the carrier between adjacent valve seals at which the valve element contacts the carrier. These rigid portions are preferably arranged directly next to the valve seals, as seen in a top view, and also ensure for example that with the exception of the valve seals, the valve element remains immobile on the carrier even when fluid flows through the multiple valve core.

When using a plate-shaped valve element having a plurality of valve seals, the valve element preferably rests against the carrier between two valve seals. In case individual separate valve elements are inserted into each of the apertures, an edge of the valve element is for example firmly fastened to the edge of the aperture in the carrier.

The valve seals are preferably arranged side by side on a straight line. It is however also possible to arrange the valve seals in different positions in the peripheral direction about the longitudinal direction, wherein each valve seal determines a circumferential line and one or a plurality of valve seals can be provided along each circumferential line. It is therefore possible to equip ducts which open laterally or from the bottom into the fluid duct with valves.

The above object is also achieved with a multiple valve having the features of claim 11. Such a multiple valve comprises a duct module having at least one elongated fluid duct which extends in a straight line along a longitudinal direction and a plurality of branch ducts which open into openings in the fluid duct which are arranged side by side along the longitudinal direction in the inner wall of the fluid duct. A multiple valve core as described above is inserted into the fluid duct such that each valve seal can seal one of the openings. It is then possible to close all present openings or only some of the openings in the fluid duct by valves of the multiple valve core. It is possible to provide a single multiple valve core for all openings of the respective fluid ducts that are to be closed, or it is possible that a plurality of multiple valve cores are inserted one behind the other into a fluid duct.

A mounting of the multiple valve core into the duct module can be carried out by a simple insertion of a multiple valve core into a fluid duct up to a position in which the valve seals are all located below the associated openings. In the mounted state, and perpendicularly to the longitudinal extension of the fluid duct, the receiving area of the multiple valve core is arranged opposite the openings of the wall of the fluid duct.

The inner wall of the fluid duct about the edge of the opening may form a valve seat for the respective associated valve seal. The valve seal is preferably configured sufficiently flexible to obtain a sufficient sealing of the opening without the valve seat having to present a specific geometry such that a processing of the edge of the opening can be omitted. An appropriate post-processing of the edge of the opening for forming a valve seat would of course also be conceivable.

The individual valves of the multiple valve are preferably configured as check valves which enable a fluid flow through the branch duct into the fluid duct and block it in the opposite direction. The valve elements thus effectively prevent the fluid from exiting the fluid duct through the branch duct.

It is possible to arrange pressure pieces in the branch ducts which are adapted to be actuated by the outlet of the respective branch duct opposite the fluid duct and which cooperate with the valve seals and can urge the latter towards the interior of the fluid duct to open the appropriate valve of the multiple valve. In this case, the individual valves do not only form simple check valves but also shutoff valves which can be opened purposefully to permit a fluid passage through the opening.

The invention also relates to a valve assembly having at least one multiple valve as described above, the duct module being part of a basic module on which a plurality of valve modules which are in fluid communication with the branch ducts can be mounted.

The valve modules are in particular configured so as to be adapted to actuate pressure pieces in the branch ducts which cooperate with the valve seals of the valves of the multiple valve to permanently open the respective valve. The respective check or shutoff valve which is formed by one respective valve seal is unblocked such that an unhindered fluid flow is possible in both directions through the branch duct from the valve module into the fluid duct and from the fluid duct into the valve module.

When the valve module is removed from the basic module, the force onto the pressure piece is omitted, and the valve closes automatically such that the fluid can no longer flow out of the fluid duct. This permits the exchange of valve modules during operation. A valve module can be connected with a plurality of branch ducts which can each include a valve of a multiple valve. It is of course also possible to connect fluid ducts with valve modules in which no valve of a multiple valve is provided, for example in case a fluid leakage out of such fluid ducts is not expected.

BRIEF DESCRIPTION OF THE DRAWINGS

The invention is described in more detail below on the basis of two example embodiments with reference to the accompanying drawings. In the drawings.

DETAILED DESCRIPTION OF THE INVENTION

For reasons of clarity, when components are present several times, not each of these components is provided with reference numbers.

The figures show a valve assembly 10 having a multiple valve 12 (FIG. 2) and two different multiple valve cores 14, 114 according to two different embodiments for the multiple valve 12 (see also FIGS. 3 to 12).

Figure 1:
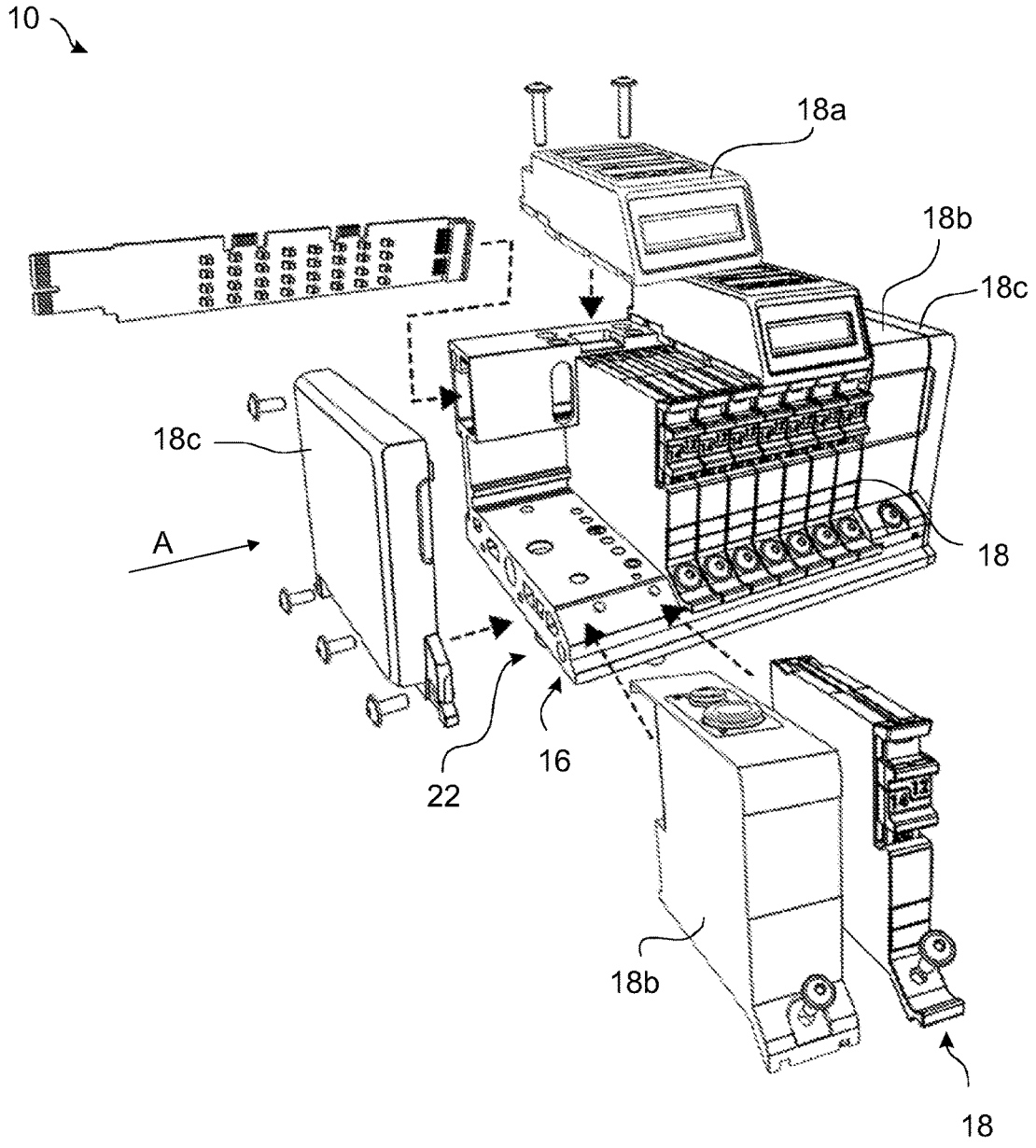
FIG. 1 shows a valve assembly according to the invention in a schematic exploded view.

The valve assembly 10 (see FIG. 1) comprises a basic module 16 onto which a plurality of functional modules can be plugged. The functional modules include in this example valve modules 18 which are for example responsible for the actual process execution of the valve assembly 10 and include the fluidic and electrical connections. The fluidic connections of the valve modules 18 communicate with fluid ducts 22 extending within the basic module 16, wherein fluid from the fluid ducts 22 can flow to the valve modules 18 and from the valve modules 18 into the fluid ducts 22.

Pure electronic modules 18*a* which only include electrical connections and in this example also feed-in modules 18*b* via which the fluids can be fed into the basic module 16, and two closure modules 18*c* which are arranged on the two sides of the basic module 16 and close the open ends of the fluid ducts 22 extending therein in a fluid-tight manner can furthermore be provided.

During operation of the valve module 10, a fluid continuously flows through the basic module 16 of the valve assembly 10, wherein pressurized fluids such as pneumatic or hydraulic work fluids can also be present in the fluid ducts 22. To be able to remove individual valve modules 18 from the valve assembly 10 during operation, individual or all fluid connections 20 in the basic module 16 which communicate with fluid connections of the respective valve module when one of the valve modules 18 is put on are equipped with valves 24. The valves 24 are each part of a multiple valve core 14, 114 (see also FIG. 2).

Figure 2:
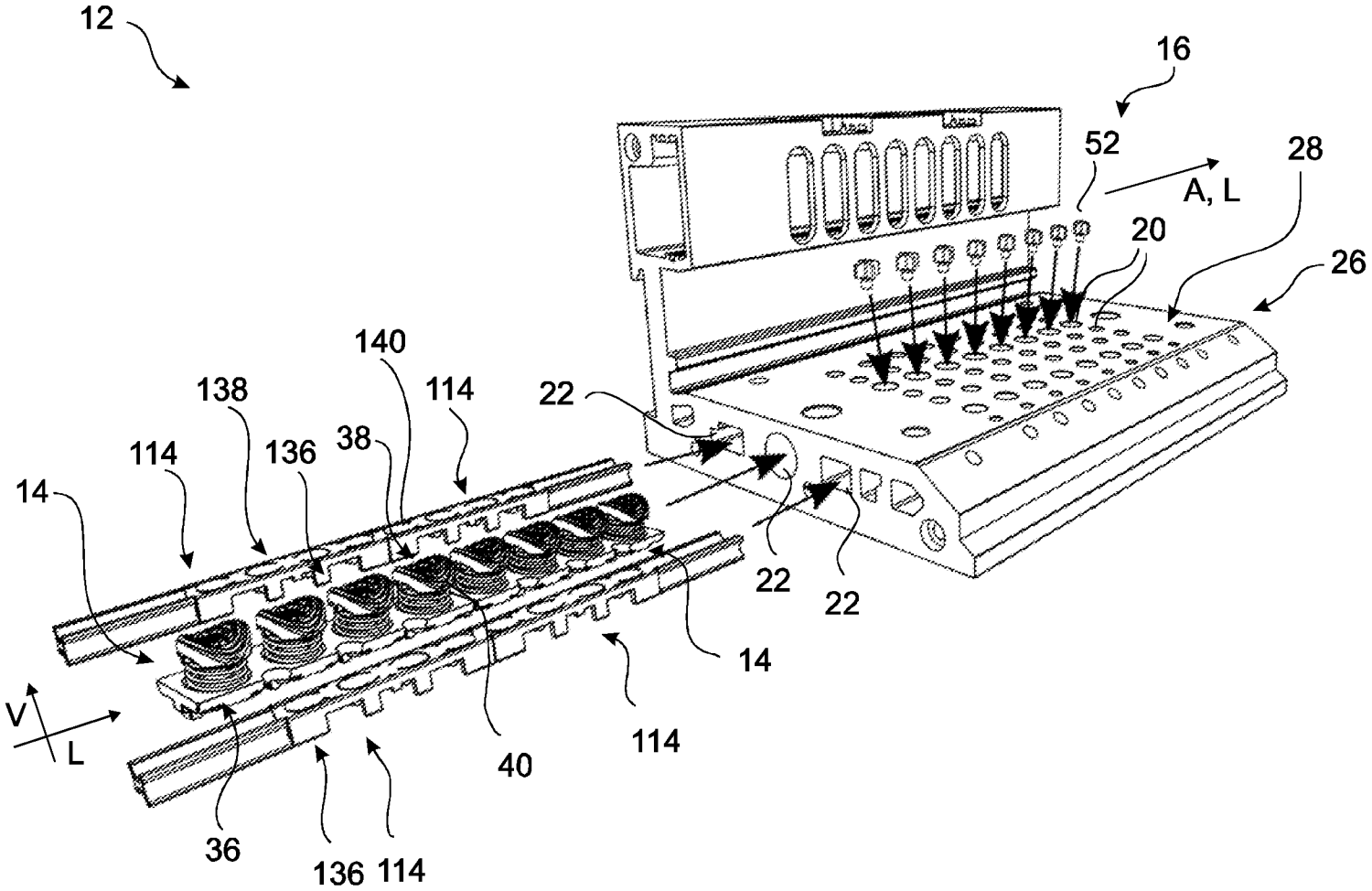
FIG. 2 shows a schematic exploded view of a multiple valve according to the invention integrated into a basic module of the valve assembly of FIG. 1, having multiple valve cores according to two embodiments according to the invention.
Figure 5:
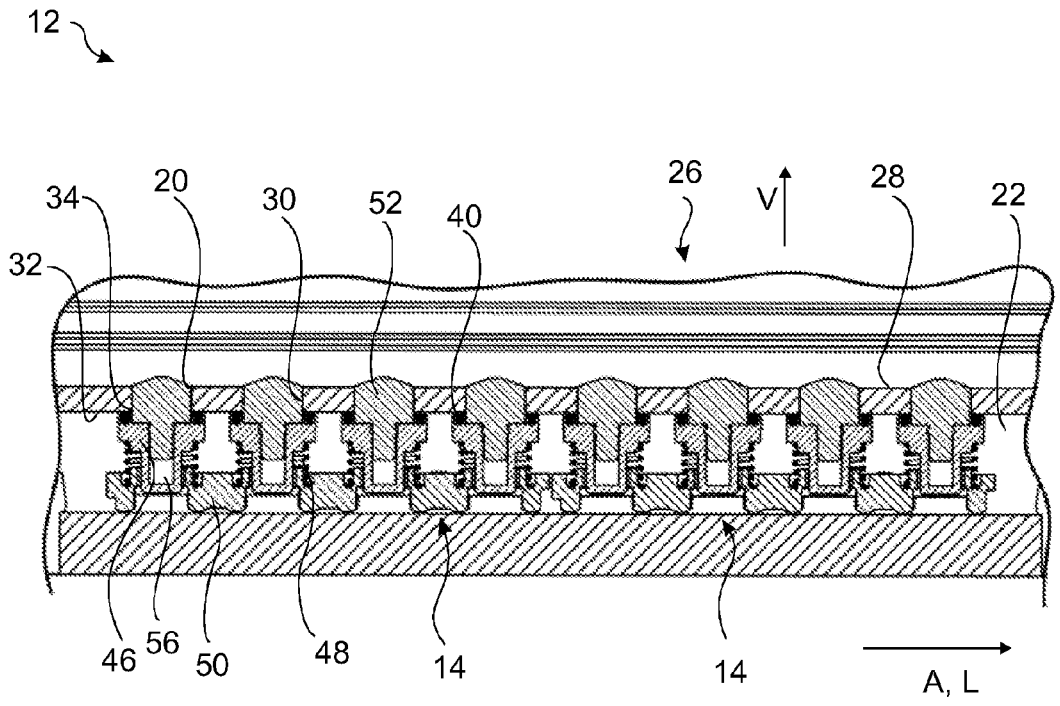
FIG. 5 shows a schematic sectional view of a multiple valve according to the invention having two multiple valve cores of the first embodiment.

As for example shown in FIGS. 2 and 5, the fluid carrying portion of the basic module 16 of the valve assembly 10 forms a duct module 26 through which a plurality of fluid ducts 22 running parallel to each other in a line-up direction A of the valve modules 18 extend.

In this example, the fluid ducts 22 have different cross-sections, however, the cross-section of the individual fluid ducts 22 remains substantially the same over the length thereof.

Branch ducts 30 extend from the individual fluid connections 20 from a fluid connection face 28 of the duct module 26 in which the fluid connections 20 of the basic module 16 are arranged, up to the fluid ducts 22. As is for example easily visible in FIG. 5, each of the fluid ducts 22 is connected with a series of fluid connections 20 arranged one behind the other in the line-up direction A. Following the fluid duct 22 in the line-up direction A, a plurality of openings 34 are formed successively on a straight line at intervals in an inner wall 32 of the fluid duct 22. Each of the openings 34 communicates with a fluid connection 20 on the fluid connection face 28 via a branch duct 30

Multiple valve cores 14, 114 are inserted into some or all fluid ducts 22 along the longitudinal direction L thereof, such that the valves 24 of the multiple valve cores 14, 114 can close the openings 34 of the branch ducts 30 leading to the fluid connections 20. The line-up direction A and the longitudinal direction L coincide in the mounted state.

Each of the multiple valve cores 14, 114 is here composed of an elongated carrier 36, 136 extending in a straight line and of at least one valve element 38, 138 which respectively includes one or a plurality of valve seals 40, 140. Each valve seal 40, 140 forms part of one of the valves 24 of the respective multiple valve core 14, 114. The valve elements 38, 138 are connected with the carrier 36, 136 so as to be non-displaceable in the longitudinal direction L. However, all valve seals 40, 140 can move with respect to the carrier 36, 136 in the closing direction V perpendicularly to the longitudinal direction L.

The two embodiments merely differ in the configuration of the carrier 36, 136 and of the valve elements 38, 138, the operating principle is however the same and is thus explained for both embodiments together.

The carrier 36, 136 is adapted to the diameter of the cross-section of one of the fluid ducts 22 so as to be adapted to be inserted therein in the line-up direction A, but in portions rests against the inner wall 32 of the fluid duct 22. The number and the distance of the valve seals 40, 140 are chosen so as to correspond to the distance of those fluid connections 20 which are to be closed by a valve 24. In the example shown, this is the case for all fluid connections 20 of the three fluid ducts 22 provided with reference numbers in FIG. 2, which are to be occupied by valve modules 18.

It is of course also possible to equip the other present fluid ducts 22 or only one or two of the three fluid ducts 22 shown with multiple valve cores 14, 114.

Figure 11:
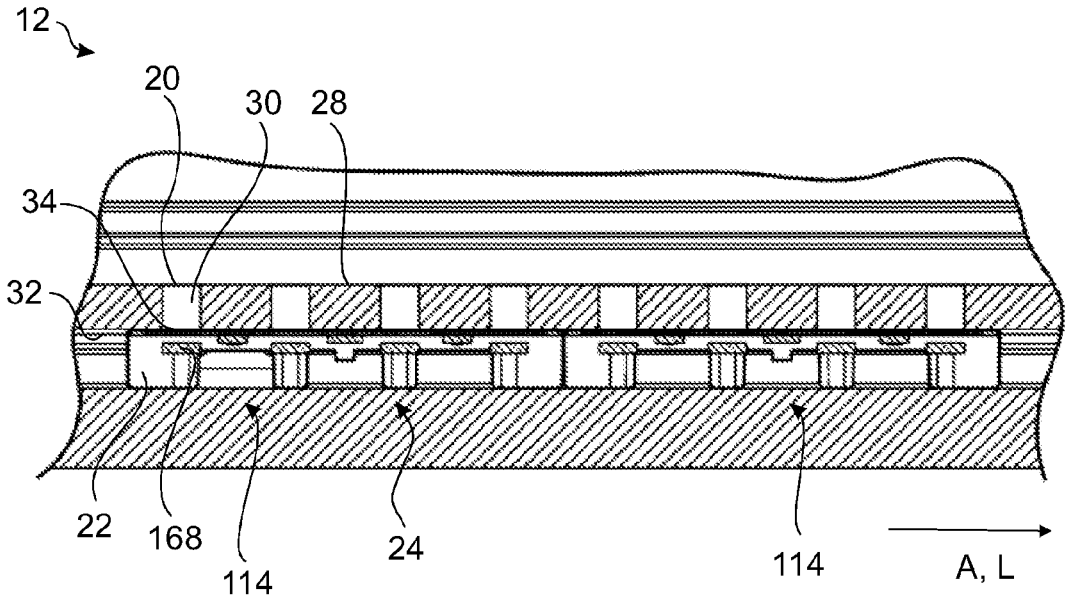
FIG. 11 shows a schematic sectional view of a multiple valve according to the invention having two multiple valve cores of FIG. 8.
Figure 12:
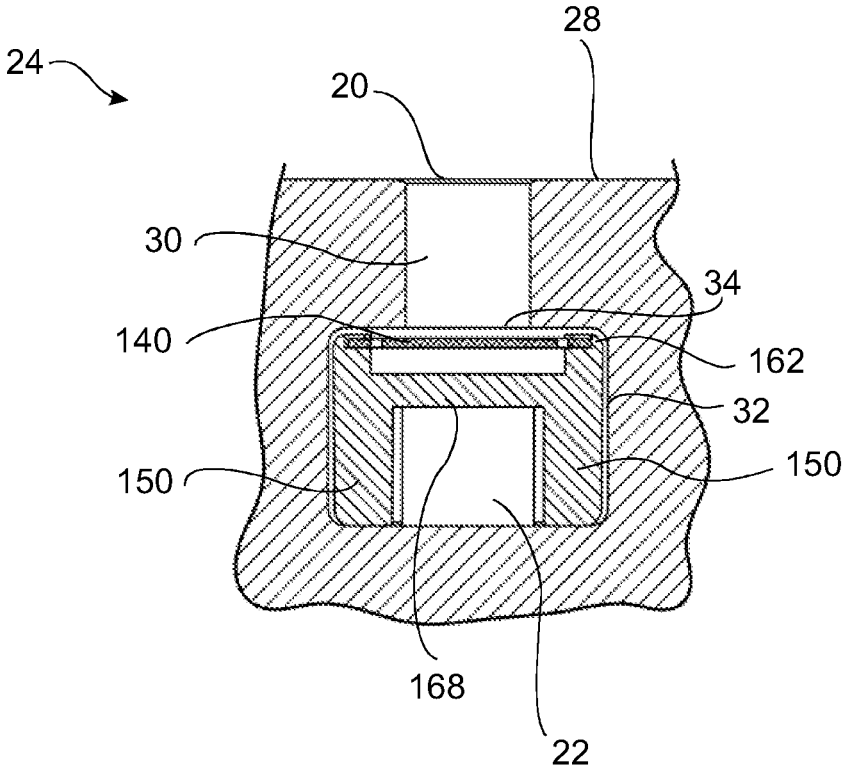
FIG. 12 shows a schematic sectional view of one of the valves of the multiple valve of FIG. 11.

In the example shown, four valve seals 40, 140, i.e. four valves 24 are respectively provided for each multiple valve core 14, 114. In this example, a total of eight fluid connections 20 are provided one behind the other for each fluid duct 22. Therefore, two multiple valve cores 14, 114 are respectively inserted one behind the other into a fluid duct 22, as illustrated in FIGS. 2, 5 and 11.

Each of the multiple valve cores 14, 114 is thus inserted into the respective fluid duct 22 in the line-up direction A such that a valve seal 40, 140 of one of the multiple valve cores 14, 114 is located below each associated fluid connection 20, more specifically below each opening 34 (see FIGS. 5 and 11). The edge of the opening 34 forms a valve seat against which the respective valve seal 40, 140 abuts.

Each of the valves 24 of the multiple valve cores 14, 114 now first acts as a check valve and prevents the fluid from flowing out of the fluid ducts 22 through the fluid connections 20 in that the openings 34 in the inner wall 32 of the fluid duct 22 are closed by the valve seals 40, 140 when the pressure prevailing in the fluid duct 22 or a spring force presses the respective valve seal 40, 140 against the edge of the opening 34.

FIGS. 3 to 7 show the multiple valve core 14 according to the first embodiment in detail.

The carrier 36 is an elongated and rigid one-piece component here made of an appropriate plastic material, and has a receiving space 42 in which here a plurality of apertures 44 which are separated from each other and are arranged on a straight line one behind the other are provided. The apertures 44 are separated from each other by rigid portions 45 which are integrally formed with the remaining carrier 36. A single valve element 38 is inserted into each of the apertures 44. The apertures 44 are spaced from the long sides 47 of the carrier 44.

Each of the valve elements 38 here comprises a valve seal 40 which is firmly connected with a tappet 46 facing the carrier 36 and a spring element 48 which is arranged between the carrier 36 and the valve seal 40.

The tappet 46 is guided on the carrier 36 in the closing direction V and is firmly connected with the valve seal 40, for example by latching or in that the valve seal 40 is injection-molded to the tappet 46. The valve seal 40 is usually made of a softer plastic material, for example a rubber or any other elastomer, whereas the carrier 36 and the tappet 46 are made of a harder rigid plastic material.

The spring element 48 is here a spiral spring used as a compression spring which urges the valve seal 40 away from the receiving area 42 of the carrier 36 towards the inner wall 32 of the fluid duct 22 when the multiple valve core 14 is inserted into the fluid duct 22.

The entire valve element 38 including the valve seal 40 is captively locked to the carrier 36 via the tappet 46, by means of a latching connection for example, which permits the insertion of the tappet 46 in the aperture 44 and a limited movement in the closing direction V but not a complete removal of the tappet 46 out of the aperture 44.

All components of the multiple valve core 14 are captively connected with each other with this or any another appropriate measure prior to insertion of the multiple valve core 14 into the fluid duct 22.

Figure 4:
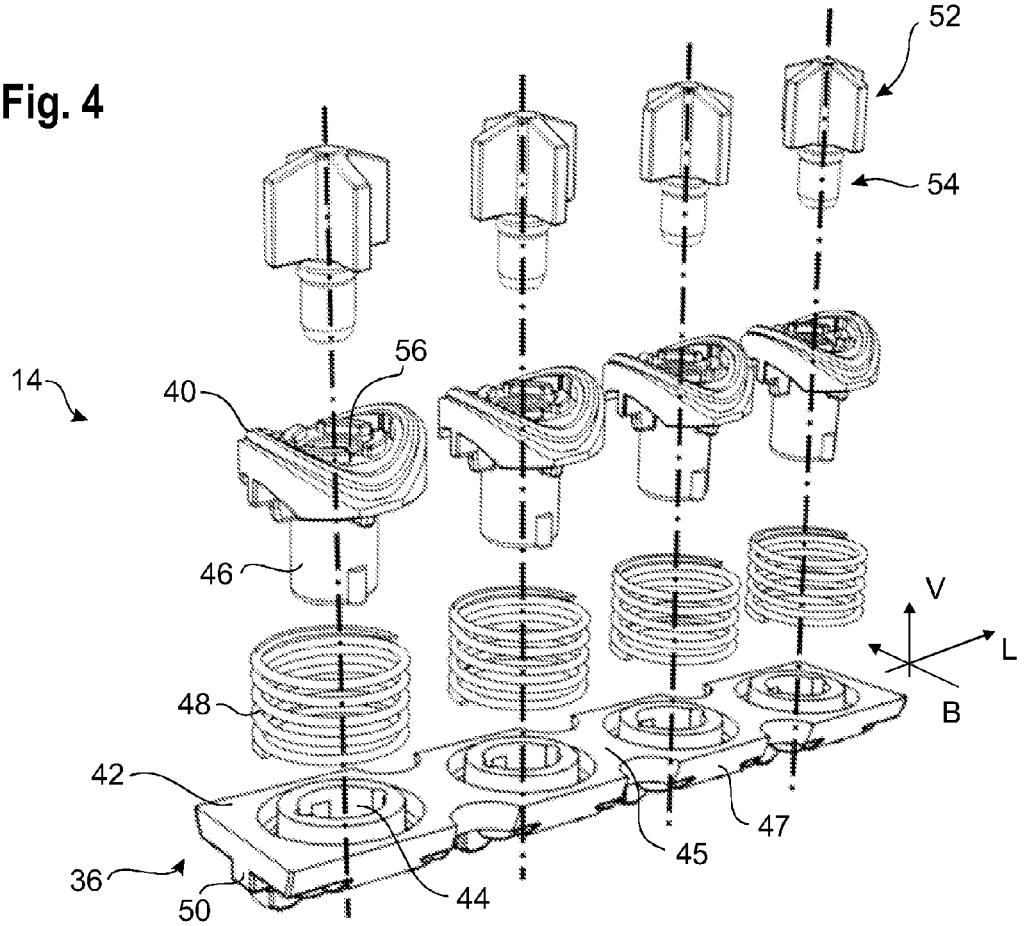
FIG. 4 shows the multiple valve core of FIG. 3 in a schematic exploded view.

The closing direction V along which the valve seal 40 can exclusively be displaced extends along the axis of the tappet 46 and perpendicularly to the surface of the carrier 36 formed by the receiving area 42, i.e. perpendicularly to the longitudinal direction L and the transversal direction B of the carrier 36 (see FIG. 4).

In this embodiment, the carrier 36 has a plurality of support portions 50 which are arranged one behind the other in the longitudinal direction L and which are each arranged in the center with respect to the transversal direction B. The support portion 50 is here integrally molded to the underside of the substantially plate-shaped receiving area 42 and is interrupted in the region of the apertures 44 such that the tappets 46 can freely move.

As seen in the longitudinal direction L, the carrier 36 has an approximately T-shaped cross-section which keeps a sufficiently large flow cross-section in the fluid duct 22 free such that the fluid flow through the fluid duct 22 is not affected.

Figure 3:
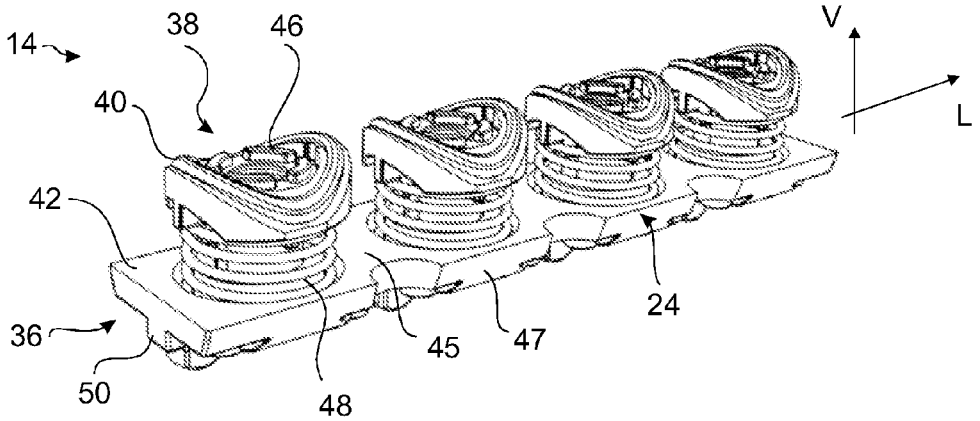
FIG. 3 shows a multiple valve core according to invention in a first embodiment in schematic perspective view.

To form the multiple valve 12, the preassembled unit composed of the carrier 36 and the valve elements 36 shown in FIG. 3 is inserted in the longitudinal direction L into the fluid duct 22 until all valve seals 40 are located below the associated fluid connections 20 and the openings 34 connected therewith in the inner wall 32 of the fluid duct 22. In this arrangement, the individual valves 24 form check valves which block a fluid flow out of the fluid duct 22 through the openings 34 to the fluid connections 20 since the spring element 48 presses the valve seals 40 against the edge of the opening 34 which serves as valve seat, as a result of which a fluid-tight closure of the openings 34 is obtained.

With a corresponding counterpressure on the part of the fluid connections 20, the spring element 48 can be compressed, as a result of which the valve seal 40 is detached from the edge of the opening 34 and permits a fluid flow through the branch duct 30 into the fluid duct 22.

The multiple valve core 14 of the first embodiment can however also be used as unlockable check valve or shutoff valve. This is for example shown in FIGS. 4 to 7.

To this end, when the multiple valve core 14 is located in its desired position in the fluid duct 22, pressure pieces 52 are inserted into the branch ducts 30 from the fluid connection face 28 and through the fluid connections 20. In this example, the pressure pieces 52 engage in central recesses 56 of the tappets 46 via an axial projection 54 and are latched there. The pressure pieces 52 are chosen so long that a tip surface 58 of the pressure piece 52 projects from the fluid connection face 28 in the closed state of the valve 24 (see FIG. 6).

In case a valve module 18 is placed onto a plug-in location of the basic module 16, the pressure piece 52 is partly pressed into the branch duct 30 due to an appropriate shape of the fluid connection of the valve module 18, for example a projection on the fluid connection, as a result of which the spring element 48 is compressed and lifts the valve seal 40 off from the inner wall 32 of the fluid duct 22. Since the force F is maintained by the inserted valve module 18, the valve 24 remains in this open position shown in FIG. 7, and a fluid flow through the branch duct 30 is possible in both directions. As can be seen in FIG. 4, the pressure piece 52 is of course configured in cross-section such that it does not unnecessarily hinder the fluid flow. To this end, it is for example possible to choose a star-shaped cross-section.

Figure 6:
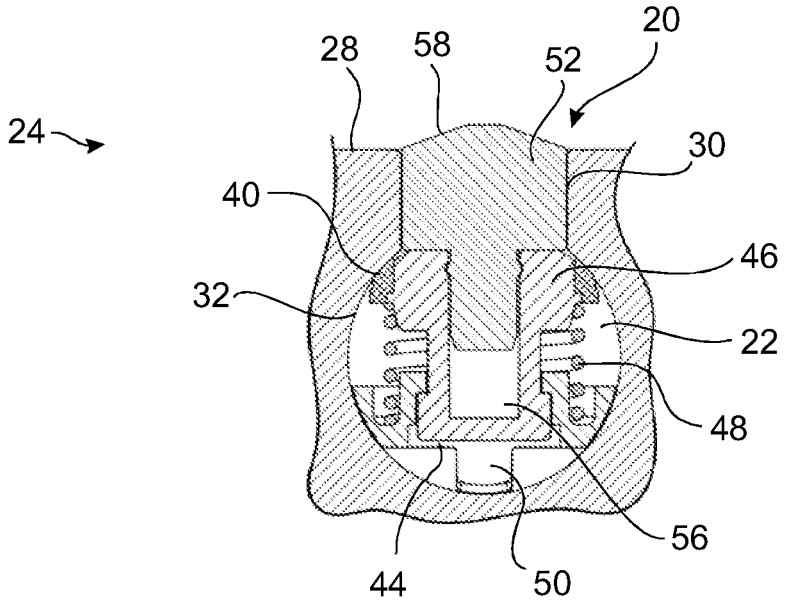
FIG. 6 shows a schematic sectional view of one of the valves of the multiple valve of FIG. 5 in the closed state.
Figure 7:
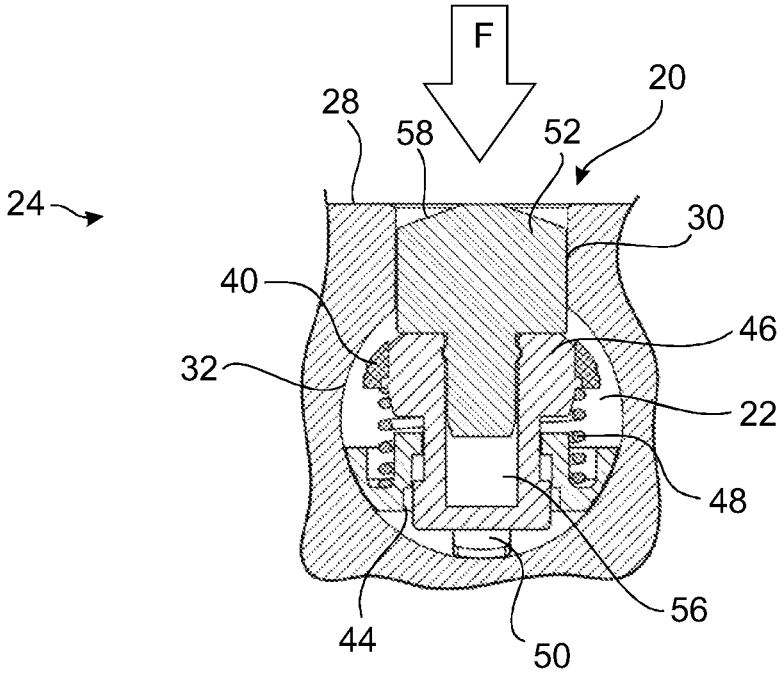
FIG. 7 shows the valve of FIG. 6 in the open state.

In case the respective valve module 18 is again removed from the basic module 16 of the valve assembly 10, the acting force F is omitted, and the spring element 48 moves the valve 24 again into the closed position shown in FIG. 6.

In this way, a valve module 18 can be removed from the valve assembly 10 or inserted therein during operation and when pressurized fluid is present within the fluid duct 22.

FIGS. 8 to 12 show the multiple valve core 114 of the second embodiment in more detail.

The carrier 136 has here two support portions 150 which extend in the longitudinal direction L parallel to each other on the exterior sides of the multiple valve core 114.

A receiving area 142 which extends approximately perpendicularly to the support portions 150 is formed therebetween. A plurality of rigid portions 145 which extend transversely and connect the two support portions 45 and which are arranged between the individual valve elements 140 like the rigid portions 45 of the first embodiment, are provided in the receiving area 142. The rigid portions 145 define apertures 144 with which a respective valve seal 140 is associated. The apertures 144 are limited in the transversal direction B by the support portions 150.

In the closing direction V, the support portions 150 slightly project from the rigid portions 145 such that the carrier 136 extends on its long sides 147 perpendicularly to the receiving area 142 at least up to the upper side 163 of the valve element 140, and such that the lateral edges of the valve element 138 are thus protected by the web 162 thus formed. The web 162 extends perpendicularly to the surface of the valve element 138, i.e. in the closing direction V at least up to the upper side 163 of the valve element 138. In this example, the web 162 extends over the entire longitudinal extension of the carrier 136.

Only one single valve element 138 is provided here on which four valve seals 140 are formed which are arranged one behind the other in the longitudinal direction L.

In this example, the valve element 138 is placed loosely onto the receiving area 142 and connected with the carrier 136 only with an interlocking fit. The valve element 138 is arranged in the receiving area 142 such that planar portions 164 between the individual valve seals 140 rest on the rigid portions 145 of the carrier 136. In these areas, the valve element 138 could also be connected in a fixed and permanent manner with the carrier 136, for example by bonding or welding or in that the valve element 138 is molded to the carrier 136 using an injection-molding method.

In order to lock the valve element 138 against a displacement in the longitudinal direction L, the carrier 136 has an interlocking fit structure which cooperates with the valve element 138 and prevents the latter from moving in the longitudinal direction. The interlocking fit structure comprises here a plurality of projections 149 which project from the long sides 147 of the carrier 136 in the transversal direction B into the receiving area 142 and against which corresponding structures 151 on the lateral edges of the valve element 138 abut which are here configured as shoulders and recesses. In case the valve element 138 is inserted in the receiving area 142, the projections 149 and the structures 151 form an interlocking fit (see FIGS. 8 and 9). The thickness of the projections 149 perpendicularly to the surface of the valve element 138 corresponds here approximately to the thickness of the valve element 138.

In this example, the lateral edges of the valve element 138 abut between the projections 149 laterally against the webs 162, which produces an additional securing in place.

The two outer valve seals 140 are here free, whereas the two inner valve seals 140 are cut out of the surface of the valve element 138 along their contours 166. It is possible to manufacture the valve element 138 by cutting, punching, injection-molding or a combination of these processes as is familiar to a person skilled in the art.

Stops 168 are formed in the receiving area 142 below the valve seals 140, i.e. opposite the closing direction V and towards the interior of the multiple valve core 114, one respective stop 168 being arranged directly below a valve seal 140. This is also visible in FIGS. 10 to 12.

These stops 168 prevent fluid that flows in through the branch duct 30 and deflects the valve seals 140 opposite the closing direction V from pressing the latter too far into the interior of the fluid duct 22.

Figure 8:
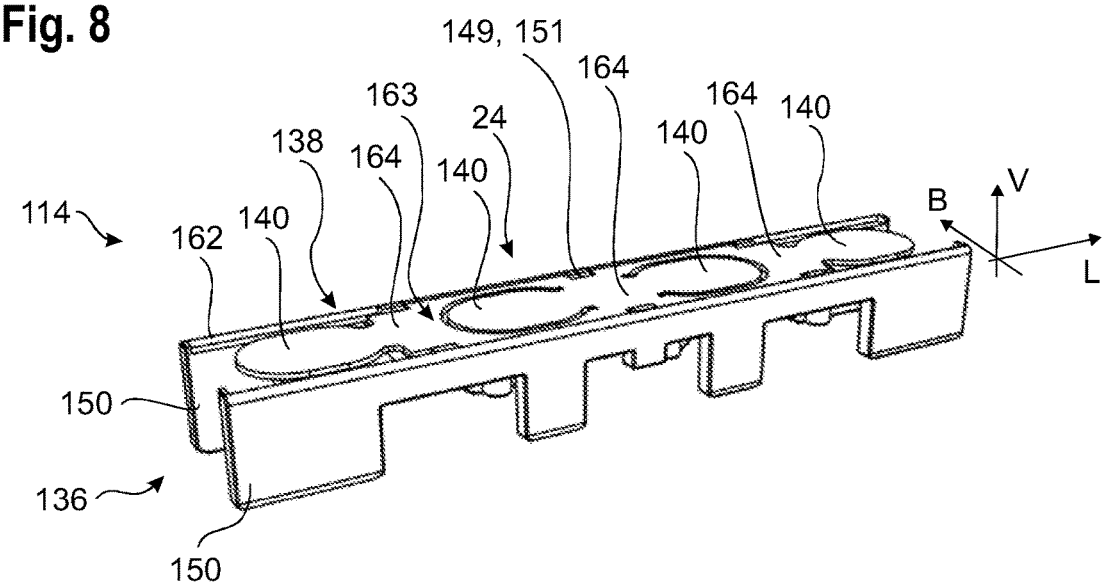
FIG. 8 shows a schematic perspective view of a multiple valve according to the invention in a second embodiment.
Figure 9:
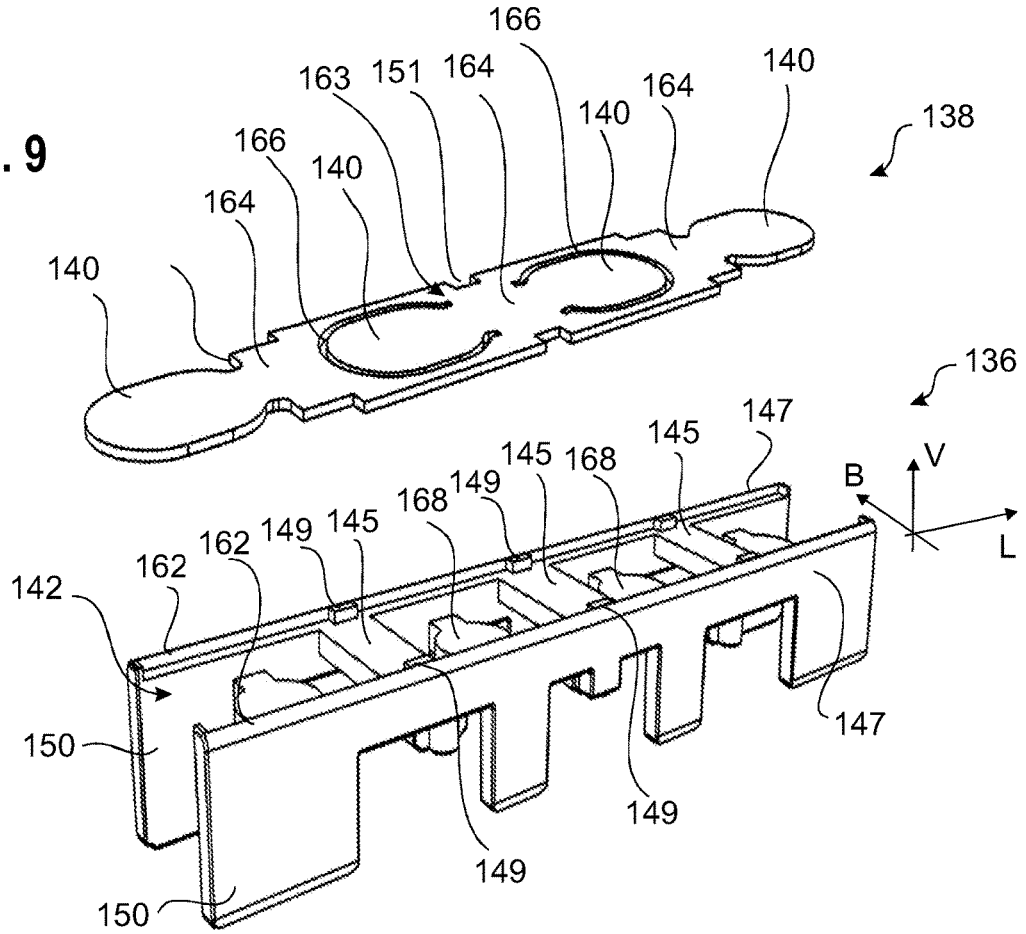
FIG. 9 shows a schematic perspective view of the components of the multiple valve of FIG. 8.
Figure 10:
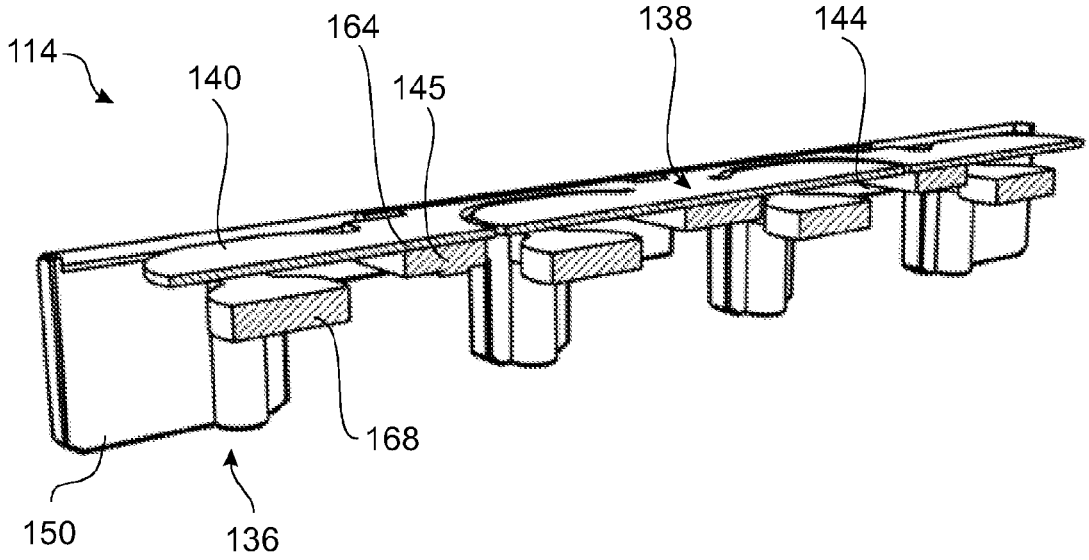
FIG. 10 shows a schematic view in a partial section of the multiple valve of FIG. 8.

The multiple valve core 114 illustrated in FIG. 8 is preassembled in this form, the valve element 138 being connected with an interlocking fit with the carrier 136. It is then inserted along the longitudinal direction L into the fluid channel 22, the web 162 protecting the valve element 138 against a contact with the inner wall 32 of the fluid duct 22. Like in the first embodiment, the multiple valve core 114 is inserted into the fluid duct 22 such that the valve seals 140 are located directly below the openings 34 associated therewith in the inner wall 32 of the fluid duct.

In this embodiment, one respective multiple valve core 114 also includes a total of four valve seals 140 which are here arranged on a single valve element 138. More or less valve seals 140 can of course also be provided on one multiple valve core 114.

In this example, eight openings are to be covered, two identically formed multiple valve core 114 are therefore inserted successively one behind the other into the same fluid channel 22.

Due to the parallel support portions 150 which extend in a flat manner, this embodiment is particularly well suited for the use in fluid ducts 22 having a rectangular cross-section, whereas the multiple valve core 14 of the first embodiment is better adapted for use in fluid ducts 22 having a round cross-section. The shape of the carrier 36, 136 can however obviously be simply adapted to any fluid duct cross-section at the discretion of a person skilled in the art, wherein in case of the use of two support portions 150, the latter could also have a shape curved perpendicularly to the longitudinal direction L to be better inserted into a fluid duct 22 having a round cross-section, for example, or wherein a carrier 36 having a single support portion 50 could also be designed for a rectangular cross-sectional shape of a fluid duct 22. It is important here that the carrier 36, 136 in the fluid duct 22 abuts against the inner wall 32 thereof so as to support the respective multiple vale core 14, 114 such that the latter remains in the desired position against the fluid pressure.

It would be conceivable to employ pressure pieces also in the second embodiment in order to be able to use the valves 24 as unlockable check valves. This shape of the valves is however more appropriate for the use a simple check valves.

It would in both embodiments be possible to provide apertures 44 and associated valve seals 40, 140 which are arranged offset in the peripheral direction about the longitudinal direction L. It is for example possible to arrange apertures 44, 144 successively in the longitudinal direction, whereas at least one of the apertures 44, 144 is however located offset to the other apertures 44, 144 with respect to the peripheral direction. It is also possible to provide a plurality of apertures 44, 144 and valve seals 40, 140 on a peripheral line, which for example supply side ducts opening into the fluid duct 22 along the inner periphery thereof with valves (not shown).

Multiple valve cores 114 of the second embodiment are thus used for example in exhaust-air fluid ducts in which a fluid flow is only necessary from the fluid connection 20 into the fluid duct 22, whereas multiple valve cores 14 of the first embodiment are for example inserted in compressed-air feed lines in which pressurized fluid from the interior of the fluid duct 22 must reach into the valve module 18 through the fluid connection 20.

The invention claimed is:

1. A multiple valve core for insertion into an elongated fluid duct which extends in a straight line along a longitudinal direction and which includes an inner wall having a plurality of openings arranged side by side along the longitudinal direction, comprising an elongated carrier and at least one valve element, the carrier having at least one support portion for abutment against the inner wall of the fluid duct and at least one receiving area in which the valve element is connected to the carrier so as to be non-displaceable with respect to the carrier at least in the longitudinal direction thereof, a plurality of valve seals for closing the openings being provided which are provided on one or on a plurality of valve elements, the valve seals being arranged successively in the longitudinal direction of the carrier and being movable in a direction perpendicular to the longitudinal direction.

2. The multiple valve core of claim 1 wherein two support portions are provided which are arranged substantially parallel to each other, the receiving area being located between the support portions and extending perpendicularly thereto.

3. The multiple valve core of claim 1 wherein at least one valve element is provided on which a plurality of valve seals is arranged.

4. The multiple valve core of claim 3 wherein a single valve element is provided on which all valve seals are arranged.

5. The multiple valve core of claim 3 wherein the valve element is plate-shaped and, as seen in the longitudinal direction rests on the receiving area between the valve seals.

6. The multiple valve core of claim 3 wherein at least one of the valve seals is delimited by a particularly linear recess in the valve element.

7. The multiple valve core of claim 1 wherein the carrier has an interlocking fit structure which cooperates with the valve element and prevents the valve element from moving in the longitudinal direction with respect to the carrier, in particular the interlocking fit structure comprising at least one projection in the receiving area which is arranged so as to block a displacement of the valve element in the longitudinal direction.

8. The multiple valve core of claim 1 wherein the carrier extends on its long sides perpendicularly to the receiving area at least up to an upper side of the valve element.

9. The multiple valve core of claim 1 wherein stops which limit a movement of the valve seals perpendicularly to the longitudinal direction towards the interior of the fluid duct are formed in the receiving area.

10. The multiple valve core of claim 1 wherein the receiving area has several apertures in the carrier which are separated from each other and in which one respective valve element is inserted which has a single valve seal.

11. The multiple valve core of claim 10 wherein the valve element, in addition to the valve seal, comprises a tappet guided in the carrier and connected with the valve seal and a spring element arranged between the receiving area and the valve seal.

12. The multiple valve core of claim 1 wherein the receiving area is formed such that a plurality of apertures with which a respective valve seal is associated is provided successively in the longitudinal direction, in particular rigid portions being provided on the carrier between adjacent valve seals on which the valve element is in contact with the carrier.

13. The multiple valve core of claim 1 wherein valves seals are arranged in different positions in the peripheral direction about the longitudinal direction.

14. A multiple valve comprising a duct module having at least one elongated fluid duct which extends in a straight line along a longitudinal direction and a plurality of branch ducts which open into openings in the fluid duct which are arranged side by side along the longitudinal direction in the inner wall of the fluid duct, and comprising at least one multiple valve core according to any of the preceding claims, which is inserted into the fluid duct such that each valve seal can seal one of the openings.

15. The multiple valve of claim 14 wherein the inner wall of the fluid duct forms a valve seat for the respective associated valve seal about the edge of the opening.

16. The multiple valve of claim 14 wherein the individual valves are configured as check valves which enable a fluid flow through the branch duct into the fluid duct or block it in the opposite direction.

17. The multiple valve of claim 14 wherein pressure pieces are arranged in the branch ducts which are adapted to be actuated by the outlet of the respective branch duct opposite the fluid duct and which cooperate with the valve seals and can urge the latter towards the interior of the fluid duct to open the appropriate valve of the multiple valve.

18. A valve assembly having at least one multiple valve of claim 14, the duct module being part of a basic module on which a plurality of valve modules which are fluidically connected with the branch ducts can be mounted, the valve modules being in particular configured such that they are adapted to actuate pressure pieces in the branch ducts cooperating with the valve seals of the valves of the multiple valve in order to permanently open the respective valve.

* * * * *